United States Patent [19]

Siegmann

[11] 4,165,676

[45] Aug. 28, 1979

[54] FIRING SAFETY FOR A PNEUMATIC NAILER

[76] Inventor: Carl Siegmann, Weizenkampstr. 60, 2800 Bremen 1, Fed. Rep. of Germany

[21] Appl. No.: 884,900

[22] Filed: Mar. 9, 1978

[30] Foreign Application Priority Data

Apr. 28, 1977 [DE] Fed. Rep. of Germany ..... 2718942

[51] Int. Cl.[2] ..... B25C 1/04

[52] U.S. Cl. ..... 91/461; 137/596.2; 173/169; 227/8; 227/130

[58] Field of Search ..... 173/169; 227/8, 130; 91/461; 137/596.2

[56] References Cited

U.S. PATENT DOCUMENTS

| | | | |
|---|---|---|---|
| 3,288,339 | 11/1966 | Bade | 227/130 |
| 3,392,632 | 7/1968 | Volkmann | 227/130 |
| 3,490,545 | 1/1970 | Lange et al. | 227/8 |
| 3,498,517 | 3/1970 | Novak | 227/8 |
| 3,502,158 | 3/1970 | Snider | 173/169 |
| 3,552,270 | 1/1971 | Lange | 91/461 |
| 3,815,475 | 6/1974 | Howard et al. | 227/130 |
| 3,970,110 | 7/1976 | Schaedler | 173/169 |

FOREIGN PATENT DOCUMENTS

| | | | |
|---|---|---|---|
| 2131849 | 8/1973 | Fed. Rep. of Germany | 227/8 |
| 2224016 | 8/1973 | Fed. Rep. of Germany | 227/8 |
| 1503069 | 5/1975 | Fed. Rep. of Germany | 227/8 |
| 2453595 | 5/1975 | Fed. Rep. of Germany | 227/8 |

*Primary Examiner*—John McQuade

*Attorney, Agent, or Firm*—Melville, Strasser, Foster & Hoffman

[57] ABSTRACT

A firing safety for a pneumatic nailer or stapler is disclosed, which safety, by itself cannot operate as a means to actuate the pneumatic device, even if the trigger and/or work responsive safety device remains in activated positions. The safety of the present invention requires a specific hand movement by the operator in order to reactivate the tool.

4 Claims, 3 Drawing Figures

FIRING SAFETY FOR A PNEUMATIC NAILER

BACKGROUND OF THE INVENTION

The invention relates to a firing safety for a pneumatic nailer having a pneumatically controlled inlet valve for pressurized air, the valve piston of which inlet valve is, in the non-actuated position of a trigger valve, impinged by pressurized air that escapes, in the actuated position of said trigger valve, through a passageway that exclusively serves for venting purposes.

Several safeties against unintended initiation of a working stroke have become known, as it cannot be excluded that a nail (in the present connection this term includes other drivable fasteners, like in particular staples), which is undesiredly driven into the open air, may cause damage.

It is common to said known firing safeties that they are subject to control by a sensor at the nose-piece of the nailer. A sensing pin projects beyond the underface of the nose-piece and is pressed back when the nose-piece is placed onto an article, usually a workpiece. As long as the sensing pin of the sensor is not depressed, no working cycle can be initiated by means of the manually actuated trigger valve.

For example, it is known from German specification No. 1 503 069 to have the workpiece sensor act on a transmitting lever located between the trigger valve and the manually actuatable trigger lever such that in the non-actuated position of the sensor an actuation of the trigger lever is not transmitted to the trigger valve. In contrast to said purely mechanical firing safety the firing safety known from German laid-open specification No. 21 31 849 engages in the pressurized air control of the inlet valve, in that the workpiece sensor, by moving a cylinder sleeve relatively to the valve piston of the trigger valve, renders the valve seat ineffective even in case the trigger lever is actuated, as long as the sensor is not depressed.

According to German published application No. 22 24 016 there is associated with the trigger valve an identical valve actuated by the workpiece sensor, and a ball valve located between the two valves allows opening of the inlet valve only in case both valves are actuated in concurrence. The same applies to the arrangement known from German laid open application No. 24 53 595, where the workpiece sensor acts on a spring-biased valve located adjacent the nailer nose-piece, which valve prevents, even though the trigger valve is actuated, exhausting and hence actuation of an intermediary valve that controls the inlet valve, as long as a workpiece sensor sensing pin in the form of a valve piston has not been depressed, thereby opening the sensor valve.

It is further common to all firing safeties described so far that the working cycle of the pneumatic nailer can be repeated infinitely, by alternately placing the nose-piece onto a workpiece, and lifting it therefrom, as long as the trigger valve is continuously actuated. In fact, this type of actively controlling the pressurized air inlet valve by means of the nosepiece firing safety is, in operation, often utilized to make use of the firing safety as a trigger valve proper, while the true trigger valve remains constantly actuated. The usual location of the trigger lever below the handle of the nailer aids such use; the said location, while being advantageous manipulatively ergonomically, leads to actuation, and continuing actuation, of the trigger lever when holding the pneumatic nailer. Then the danger exists that a person accustomed to such handling keeps the trigger valve of the nailer actuated even in a condition where the nailer does not rest on a workpiece, and then unintentionally actuates the workpiece sensor, whereby a working cycle is initiated, and a nail is driven out undesiredly.

BRIEF SUMMARY OF THE INVENTION

It is the object of the invention to provide a firing safety that is incapable of acting as an active control means, and to repeat working cycles, when the remaining control means are kept in their actuated position.

With a pneumatic nailer of the kind described before, in which opening of the pressurized air inlet valve is effected by exhausting one face of the valve piston via a passageway serving exclusively for such exhaust, said object is solved, according to the invention, by a manually actuatable safety valve disposed in said venting passageway, said safety valve in its non-actuated position blocking said venting passageway. This not only amounts to a manually actuated safety that requires a specific hand movement by the operator, but primarily it is impossible to initiate a new working cycle by releasing and reactuating the safety valve (with the rest of the tool being kept actuated). Even if the operator, upon termination of a working cycle during which a fastener has been driven into a workpiece, removes the nailer from the workpiece and keeps the trigger valve actuated (but not the safety valve which is more difficult to actuate manipulatively), another intentional or unintentional actuation of the workpiece sensor (that in the meantime returned into its rest position) would not lead to initiation of a new working cycle. Only if the safety valve is actuated again, a new working cycle can be initiated.

Preferably, the safety valve is a spring biased piston valve, a lever acting on the piston of said piston valve, said lever being pivotally linked to the housing of the nailer, and being pivotable about an axis extending transverse in relation to the longitudinal extension of the nailer. The structural expenditure for such a valve is low, and the location of the pivot axis of the actuating lever prevents undesired actuation of the safety valve when the nailer is put on a table surface or the like.

In case the invention is to be applied to a pneumatic nailer, in which the venting passage leads through the cap of the working cylinder, it is advantageous to locate the safety valve within the cap, and to link the lever to the cap, the lever being elongated by an actuating arm projecting into the vicinity of the trigger valve.

If on the other hand the penumatic nailer is of the kind, in which venting is effected along the pin of the trigger valve, the invention provides for the piston of the safety valve surrounding the pin of the trigger valve concentrically as well as sealingly in the actuated position of the trigger valve, but non-actuated position of the safety valve.

DETAILED DESCRIPTION

Figure 1:
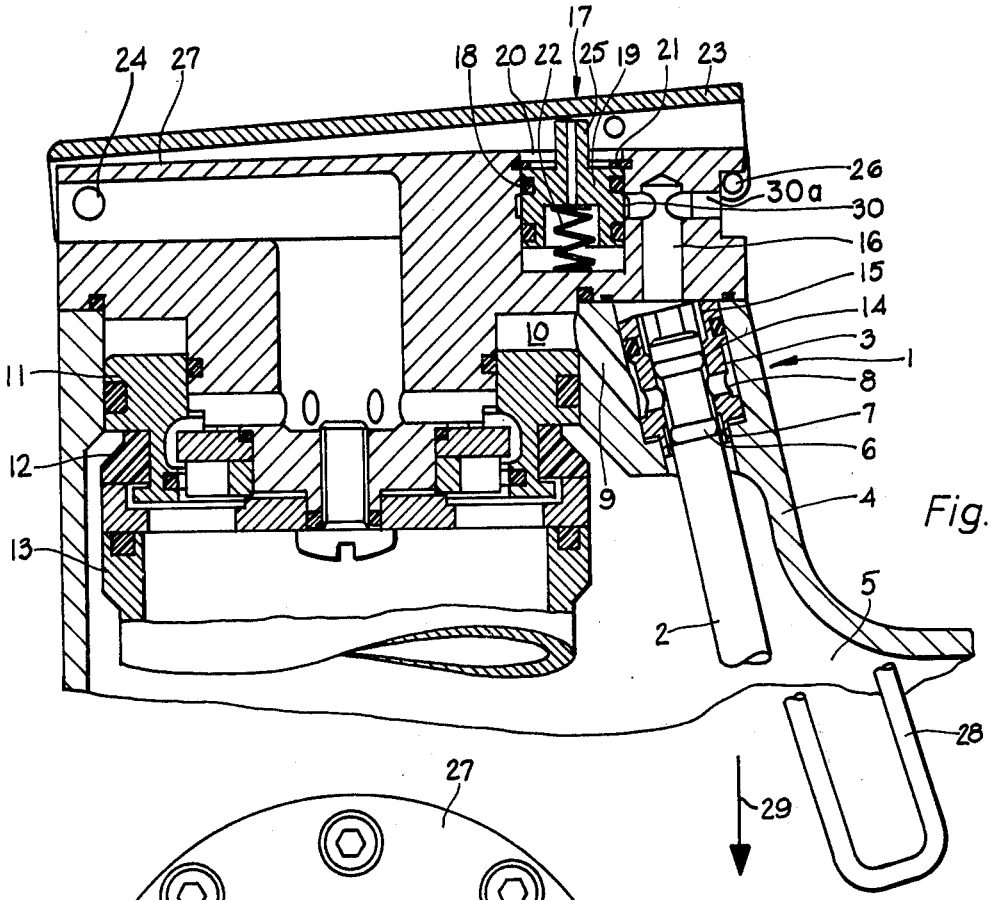
FIG. 1 is a cross section of the cap and the adjacent parts of a pneumatic nailer.
Figure 2:
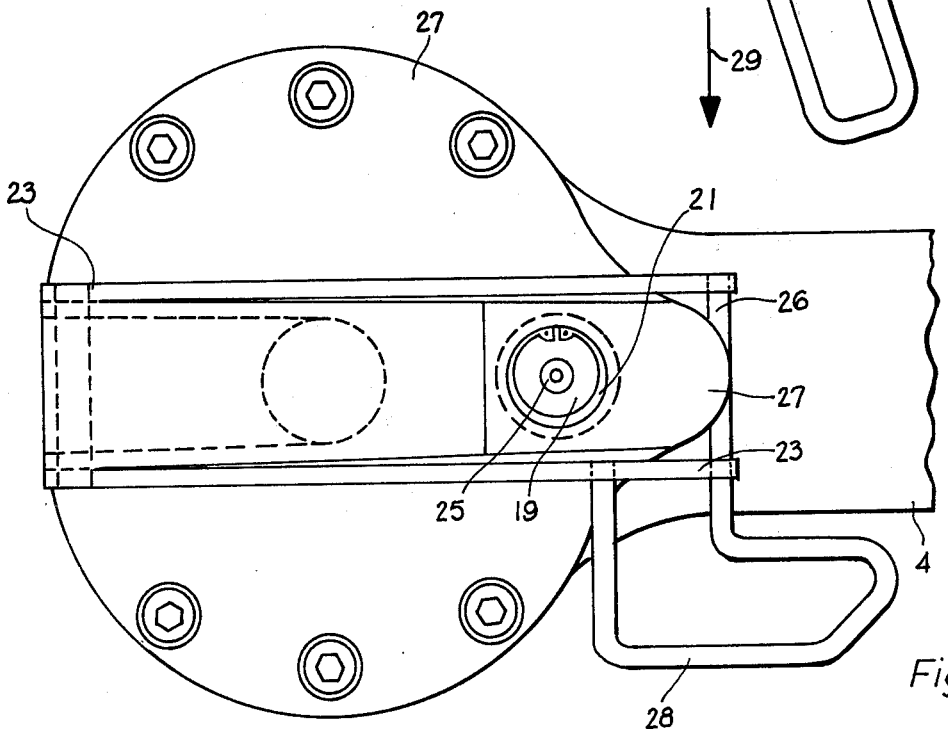
FIG. 2 is a plan view of the portion of the nailer shown in FIG. 1.

In the embodiment shown in FIG. 1 the trigger valve 1 is formed by a pin 2 and a valve sleeve 3. Pin 2 can, by means of a trigger lever (not shown) be manually moved in its longitudinal direction, upwardly in FIG. 1. In its rest position shown in FIG. 1 valve pin 2 is urged downwardly by pressurized air which is present in an air reservoir 5 (connected to a pressurized air line) provided in the nailer housing 4, the pressurized air impinging on an enlarged piston face (not shown) at the other end of valve pin 2. Thus, the pressurized air flows from reservoir 5 past O-ring 6 on pin 2 through recesses 7 in the valve sleeve 3, and through radial bores 8 within sleeve 3, and finally through an oblique channel 9 within housing 4 into a chamber 10 above the inlet valve 11, so that said valve together with its sealing ring 12 is pressed onto a cover of the working cylinder 13, and maintained in its position.

Manual actuation of trigger valve 1 moves valve pin 2 upwardly, whereby O-ring 6 leaves recesses 7 and comes into sealing engagement to sleeve 3, while a further O-ring 14 disposed more upwardly reaches recesses 15. Pressurized air in channel 9 and chamber 10 is thus separated from reservoir 5 and connected to space 16 above valve pin 2, which is however blocked from atmosphere by safety valve 17. O-ring 18 seals valve piston 19 of safety valve 17 against the wall of bore 20 serving as valve cylinder. A retaining ring 21 prevents valve piston 19 from falling out, said piston being biased by spring 22 in the closing sense of safety valve 17.

A lever 23 is linked to housing cap 27 and pivotable about axis 24 extending transversely with respect to the longitudinal direction of the nailer. Lever 23 abuts a pin-like extension 25 of valve piston 19. Pin 26 fastened to lever 23 engages under an extension of cap 27 and limits a pivotable movement of lever 23. Actuating arm 28 extends from pin 26 in the form of a wire bow the free end of which projects into the vicinity of the actuating lever or trigger (not shown) of the trigger valve. Actuating arm 28 can thus be actuated by an operator with the thumb of his hand which holds the tool in usual manner, thereby pulling the trigger lever with at least one of his remaining fingers. The direction of actuation of actuating arm 28 is parallel to the longitudinal extension of nailer housing 4.

If the actuating arm 28 is pressed in the direction of arrow 29, then lever 23 pivots about axis 24, and valve piston 19 with pin extension 25 is moved within bore 20 against the force of spring 22. This moves O-ring 18 into recess 30 which is connected to space 16, and pressurized air present in this space in case of actuated trigger valve 1 can escape through bore 20 into atmosphere. This removes pressure from chamber 10 above inlet valve 11, which is thus opened under the action of pressurized air from reservoir 5, said air still acting on inlet valve 11 in the opposite direction, and a working cycle commences. The recess 30 is closed by means of a plug 30*a*, after drilling during manufacture. If trigger valve 1 (as well as a workpiece sensing safety at the nosepiece of the nailer if provided) is kept actuated, the working piston remains in its lowermost position, for the inlet valve 11 remains open. Even closing of safety valve 17, by releasing actuating arm 28, does not change this condition, so that even repeated pressing of actuating arm 28 cannot lead to another working cycle. Only releasing trigger valve 1, and consequent return of valve pin 2 in its lower position, admits again pressurized air into chamber 10 and the upper side of inlet valve 11, whereby said valve is closed, while at the same time the space above the working piston is opened to atmosphere. Thus, the working piston (not shown) returns in its uppermost position.

From the drawing it can be taken that recesses 15 within sleeve 3 of trigger valve 1, space 16, recesses 30, and bore 20 form a passageway serving exclusively for venting inlet valve 11, while channel 9 and radial bores 8 both admit pressurized air to chamber 10 above inlet valve 11, and serve as an exhaust therefor.

Figure 3:
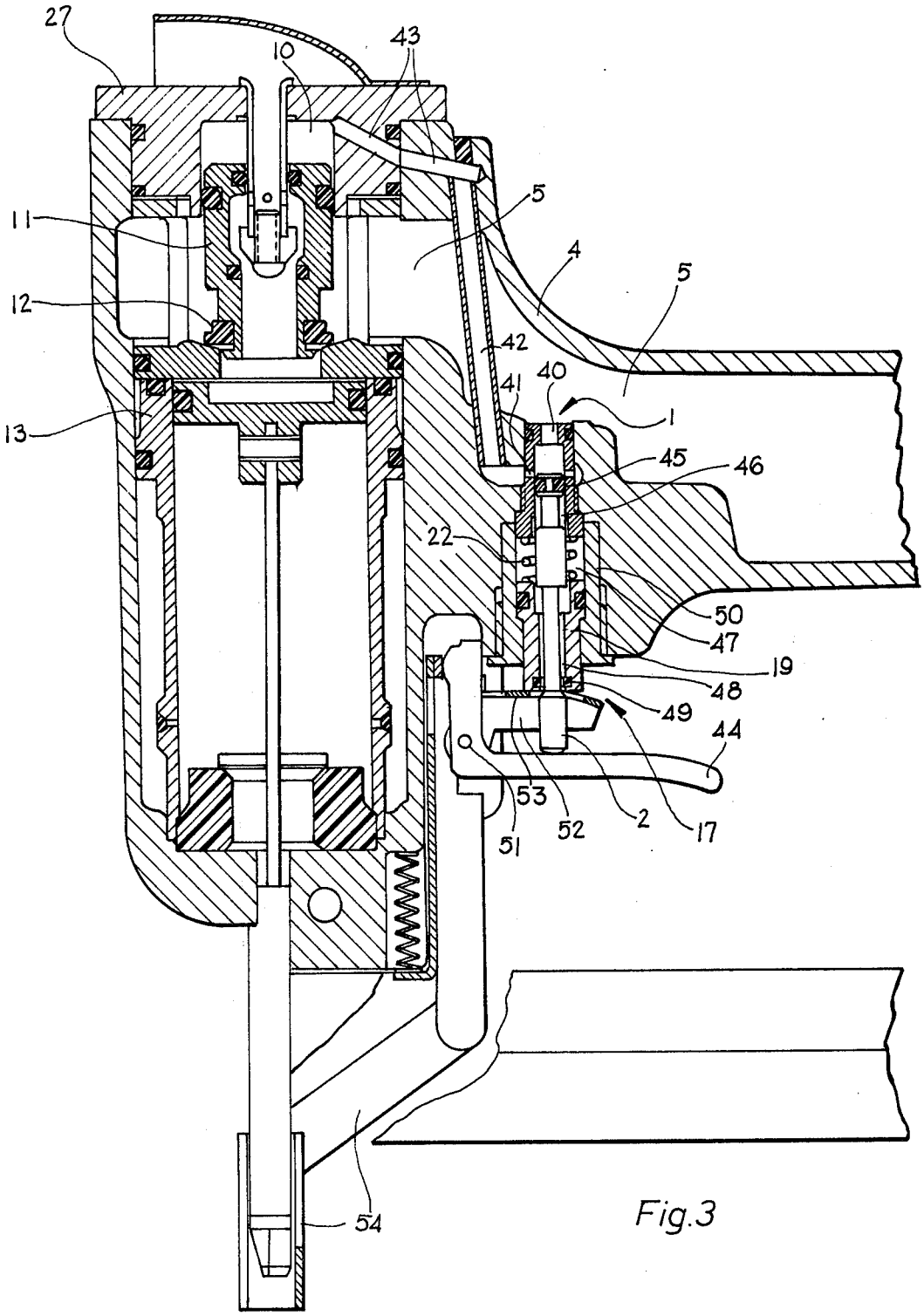
FIG. 3 is a more comprehensive cross section, similar to FIG. 1, of another embodiment.

According to the embodiment shown in FIG. 3 pressurized air flows, in the non-actuated position of trigger valve 1, through bores 40, 41 into passage 42 and further into channel 43, thereby reaching chamber 10 above inlet valve 11. If trigger valve 1, by manually actuating trigger lever 44 and thus longitudinally moving valve pin 2, is moved into its actuated position, O-ring 45 disconnects bores 40 and 41, thus separating passage 42 from further air supply from reservoir 5. The pressurized air at this time present in chamber 10 and passage 42 as well in channel 43 could flow to atmosphere through recess 46 in pin 2 of trigger valve 1, into a chamber 47, and on through a further recess 48 within pin 2, if this would not be prevented by O-ring 49 which upon actuation of trigger valve 1 and consequent longitudinal movement of pin 2 engages sealingly the non-recessed front end of pin 2.

O-ring 49 is located within valve piston 19 of safety valve 17. Valve piston 19 is sealed and movable within sleeve 50 forming chamber 47, against the action of spring 22, which urges valve piston 19 in its rest position shown in FIG. 3.

An actuating lever 52 pivotably linked to housing 4 laterally offset, and coaxially to trigger lever 44, and thus pivotable about axis 51, abuts the underside of valve piston 19 by means of an extension 53 that overlies laterally trigger lever 44. Pivotable movement of lever 52, directed upwardly in FIG. 3, about axis 51, for instance by thumb pressure on an upwardly directed extension (not shown) of lever 52, like actuating arm 28, leads to the relative position of O-rings 49 and recesses 48 within valve pin 2 shown in FIG. 3, even if trigger lever 44 should be actuated, and valve pin 2 of trigger valve 1 should be depressed. Thus, pressurized air in passage 42, channel 43, and chamber 10, can escape along valve pin 2, whereupon inlet valve 11 opens.

If now lever 52 is released, while trigger valve 1 is kept actuated, chamber 10 as well as channel 43 and passage 42 will be blocked against atmosphere. However, nothing else happens, and reactuating of lever 52 does not lead to initiation of a new working cycle. Rather, this requires releasing of trigger lever 44 and/or releasing of a working pin sensor 54 indicated in FIG. 3, which in its released condition does not allow effective actuation of trigger valve 1. Construction particulars of sensor 54 and its function need not be discussed here, as they are well known in the art.

I claim:

1. In a pneumatic nailer having a housing, a cylinder and piston in said housing, a pneumatically controlled inlet valve for admitting pressurized air to said cylinder, a venting passage exclusively for venting said pressurized air to atmosphere, a manually actuatable safety valve disposed in said venting passage, and a trigger valve, said trigger valve and said safety valve being independently actuatable, said inlet valve being subjected to pressurized air when said trigger valve is in its unactuated position, and the pressurized air acting on said inlet valve being vented to atmosphere through said venting passage when said trigger valve and said safety valve are actuated, and said safety valve, in its unactuated position, blocking said venting passage.

2. A nailer according to claim 1, characterized in that the safety valve (17) is a spring biased piston valve, and a lever (23;52) acting on the piston (19) of said piston valve is pivotally linked to the housing of the nailer, and is pivotable about an axis (24;51) extending transverse in relation to the longitudinal axis of the nailer.

3. A nailer according to claim 2 in which the venting passage leads through the housing cap, and characterized in that the safety valve (17) is located in the cap (27), and the lever (23) is linked to the cap, the lever having an actuating arm projecting into the vicinity of the trigger valve.

4. A nailer according to claim 2 wherein the trigger valve has a pin, and venting is effected along the pin of the trigger valve, characterized in that the piston (19) of the safety valve (17) surrounds the pin (2) of the trigger valve concentrically as well as sealingly in the actuated position of the trigger valve, but non-actuated position of the safety valve.

* * * * *